US006504463B1

(12) United States Patent
Kato et al.

(10) Patent No.: US 6,504,463 B1
(45) Date of Patent: Jan. 7, 2003

(54) COIL AND SURFACE-MOUNTING-TYPE COIL COMPONENT

(75) Inventors: Hidekazu Kato, Takefu (JP); Tetsuya Morinaga, Fukui (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/521,794

(22) Filed: Mar. 9, 2000

(30) Foreign Application Priority Data

Mar. 12, 1999 (JP) ..... 11-065841

(51) Int. Cl.[7] ..... H01F 27/02

(52) U.S. Cl. ..... 336/83; 336/192; 336/200; 336/232

(58) Field of Search ..... 336/65, 83, 183, 336/192, 200, 212, 223, 232

(56) References Cited

U.S. PATENT DOCUMENTS

| | | | | |
|---|---|---|---|---|
| 4,424,504 A | * | 1/1984 | Mitsui et al. | 336/83 |
| 4,555,123 A | * | 11/1985 | Tamada et al. | 336/83 |
| 4,748,405 A | * | 5/1988 | Brodzik et al. | 336/174 |
| 4,837,544 A | * | 6/1989 | McDougal | 336/185 |
| 4,959,630 A | * | 9/1990 | Yerman et al. | 336/83 |
| 6,114,932 A | * | 9/2000 | Wester et al. | 336/65 |

FOREIGN PATENT DOCUMENTS

| | | |
|---|---|---|
| JP | 5-275253 | * 10/1993 |
| JP | 6-310358 | 11/1994 |
| JP | 7-130560 | 5/1995 |
| JP | 7-245217 | 9/1995 |
| JP | 7-288210 | 10/1995 |
| JP | 9-232154 | 9/1997 |
| JP | 9-270334 | 10/1997 |
| JP | 10-41152 | 2/1998 |

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A surface-mounting-type coil component includes a wound coil, a box-shaped core member, and a core member defining a cover. At two ends of the coil, two extending portions are extended in opposite directions so as to be separated by 180 degrees along a straight line passing through the center of the wound coil. The box-shaped core member includes a recess for accommodating the coil therein. The four corners of the box-shaped core member have been removed. Grooves are formed in a side wall defining the recess at 90 degree intervals. Portions of the two extending portions are accommodated in the grooves, with one end of each extending portion being disposed at a mounting surface of the box-shaped core member so as to be extended outwardly.

19 Claims, 9 Drawing Sheets

COIL AND SURFACE-MOUNTING-TYPE COIL COMPONENT

BACKGROUND OF THE INVENTION

1. Field of the Invention

The present invention relates to a coil and a surface-mounting-type coil component, and more particularly, to a coil defined by flat straight wire which has been edgewise wound and to a surface-mounting-type coil component including the coil.

2. Description of the Related Art

Conventional surface-mounting-type coil components including edgewise wound coils are shown in FIGS. 8 and 9. In the coil component 1 illustrated in FIG. 8, a coil 2 is sandwiched between a pair of E-shaped ferrite core members 3. The coil 2 is formed by concentrically winding a straight wire into a circular configuration (or by subjecting it to edgewise winding). Extending portions 2*a* and 2*b* of the coil 2 extend parallel to each other and in the same direction.

In the coil component 5 shown in FIG. 9, a coil 6 is accommodated in a box-shaped ferrite core member 7. The coil 6 is defined by a flat straight wire which has been edgewise wound. A ferrite core member 8 is inserted into a hole 6*c* in the center portion of the coil 6, and a ferrite core member 9 defining a cover is placed on the core member 8 and the coil 6 to cover them. Extending portions 6*a* and 6*b* of the coil 6 are extended parallel to each other and in the same direction.

Ordinarily, the extending portions 2*a* and 2*b* of the coil 2 of the coil component 1 are bent along the surfaces of the ferrite core members 3 in order to be used as surface-mounting external electrodes. Similarly, the extending portions 6*a* and 6*b* of the coil 6 of the coil component 5 are bent along the surface of the ferrite core member 7 in order to be used as surface-mounting external electrodes. However, the extending portions 2*a* and 2*b* of the conventional coil component 1 and the extending portions 6*a* and 6*b* of the conventional coil component 5 are arranged at one side of the center of the windings of the coil 2 and at one side of the center of the windings of the coil 6, respectively. Therefore, the coils 2 and 6 in the axial direction are such that the side where the extending portions 2*a* and 2*b* and the side where the extending portions 6*a* and 6*b* are located are higher than the opposite side where the extending portions 2*a* and 2*b* are not located and the opposite side where the extending portions 6*a* and 6*b* are not located, respectively. Consequently, when, for example, as shown in FIG. 10, the extending portions 2*a* and 2*b* of the coil 2 are bent along the surfaces of the ferrite core members 3, the coil 2 becomes tilted, often causing end portions of the extending portions 2*a* and 2*b* to be elevated relative to the surfaces of the ferrite core members 3. This prevents the mounting surface of the conventional coil component 1 from being level, thereby making the component 1 difficult to mount on a printed circuit board.

In addition, when the coil components 1 and 5 are to be mounted on a printed circuit board or other substrate, the surface-mounting external electrodes defined by bending the extending portions 2*a* and 2*b* and the surface-mounting external electrodes defined by bending the extending portions 6*a* and 6*b* are disposed only on one side of the coil component 1 and the coil component 5, respectively. Thus, the coil components 1 and 5 may get pulled to one side and may be mounted in a tilted state. Further, after being mounted on a printed circuit board, the coil components 1 and 5 are unstable.

The box-shaped ferrite core member 7, the ferrite core member 8, and the ferrite core member 9 of the coil component 5 define a magnetic circuit that is superior to that defined by the pair of E-shaped ferrite core members 3 of the coil component 1. However, even with the magnetic circuit of the coil component 5, the extending portions 6*a* and 6*b* of the coil 6 disposed at one side of the center of the windings of the coil 5 locally interrupt the magnetic path, so that magnetic flux lines tend to concentrate at the side where the extending portions 6*a* and 6*b* are not disposed (at side A in FIG. 9), which is opposite to the side of the extending portions 6*a* and 6*b*. Therefore, magnetic saturation easily occurs, thereby it is difficult to generate inductance with high efficiency. Further, portions P1 at the four corners of the core member 3 of the coil component 1 and portions P2 at the four corners of the core member 7 of the coil component 5 do not function effectively as magnetic circuits, as a result of which space is wasted.

SUMMARY OF THE INVENTION

To overcome the problems described above, preferred embodiments of the of the present invention provide a coil and a surface-mounting-type coil component, which enhances mountability and which achieves highly efficient inductance.

According to a preferred embodiment of the present invention, a coil includes an edgewise wound portion and two extending portions extending from two locations of the edgewise wound portion, the two extending portions being arranged to extend opposite to each other so as to be separated by an angle of 180 degrees along a straight line passing through a center of the edgewise wound portion.

This unique structure and arrangement makes it possible to extend the extending portions of the coil using the technique used to wind a straight wire in an edgewise manner. In other words, the extending portions from the respective end of edgewise winding can be easily extended by edgewise bending.

An angle defined by the two locations where the edgewise winding is terminated and an angle formed by the two extending portions may differ. Since the directions in which the extending portions are extended are not restricted, any coil inductance value can be set.

According to another preferred embodiment of the present invention, a surface-mounting-type coil component includes a coil having an edgewise wound portion and two extending portions extending from two locations of the edgewise wound portion, the two extending portions being arranged to extend opposite to each other so as to be separated by an angle of 180 degrees along a straight line passing through a center of the edgewise wound portion, and a core accommodating the coil therein.

The core may preferably be a first core member having a recess for accommodating the coil therein, and a second core member defining a cover and arranged to cover the recess of the first core member.

The first core member is preferably box shaped and may include grooves for accommodating the extending portions of the coil therein. The grooves are preferably located in a side wall defining the recess at 90 degree intervals or at 180 degree intervals.

By virtue of the above-described structures, the two extending portions of the coil are extended in opposite directions so as to be separated by 180 degrees along the straight line that passes through the center of the edgewise wound portion of the coil. Therefore, even when the extending portions are bent along the surface of the core, they are not elevated from the surface of the core. In addition, the surface-mounting external electrodes defined by bending the extending portions are disposed on both sides of the coil component. Therefore, the coil component will not be mounted in a tilted state on a printed circuit board or other substrate, thereby eliminating shaking of the coil component that has been mounted on the printed circuit board. Further, since the extending portions of the coil are not disposed at one side of the center of the winding of the coil, magnetic flux lines are not concentrated at local portions of the core, thereby improving magnetic saturation properties.

When the core includes a box-shaped core member and another core member which defines a cover, a corner of the box-shaped core member may be removed. This allows substantially the entire box-shaped core member to function effectively as a magnetic circuit.

When the box-shaped core member includes grooves for accommodating the extending portions of the coil therein, a corner of the box-shaped core member may be removed.

Other features, elements, advantages and charactestics of the present invention will become apparent from the following detailed description of preferred embodiments with reference to the attached drawings.

DETAILED DESCRIPTION OF PREFERRED EMBODIMENTS

A description will now be provided of preferred embodiments of the coil and the surface-mounting-type coil component in accordance with the present invention, with reference to the drawings.

Figure 1:
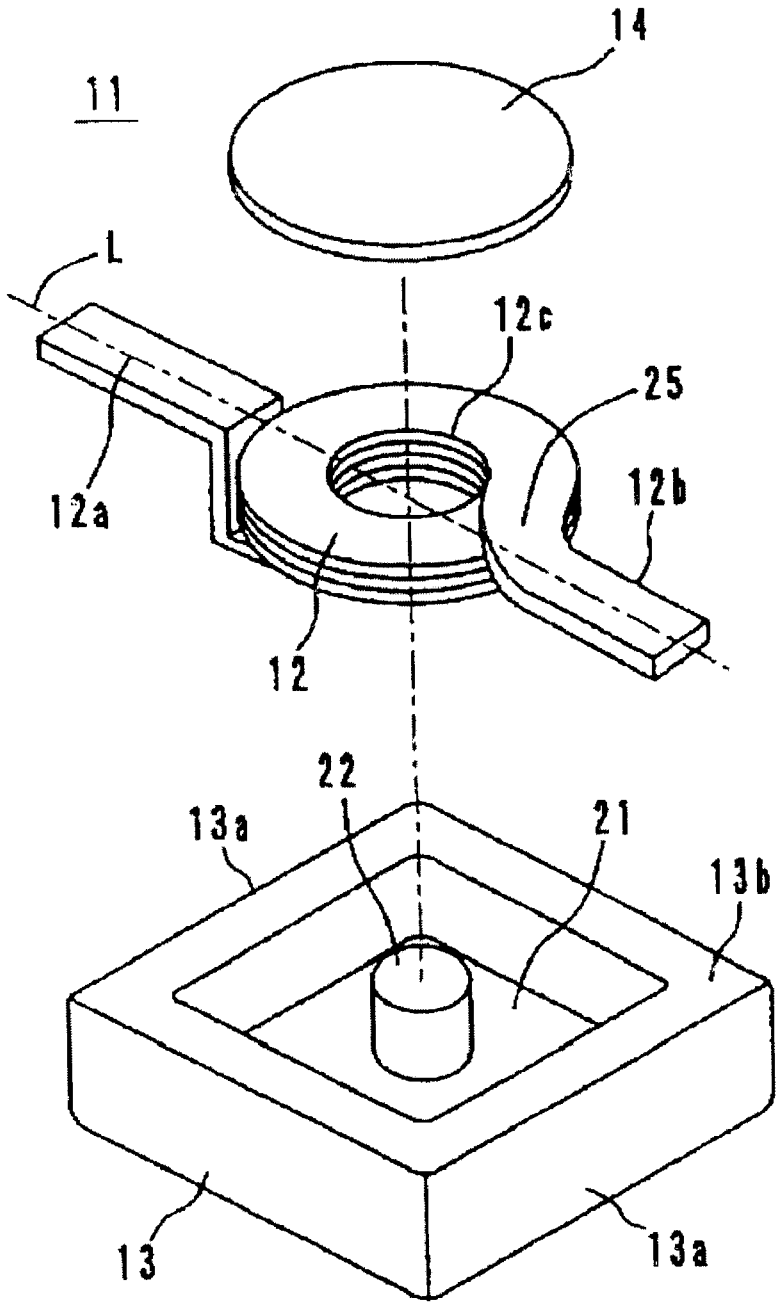
FIG. 1 is an exploded perspective view of a first preferred embodiment of the coil and the surface-mounting-type coil component in accordance with the present invention.
Figure 2:
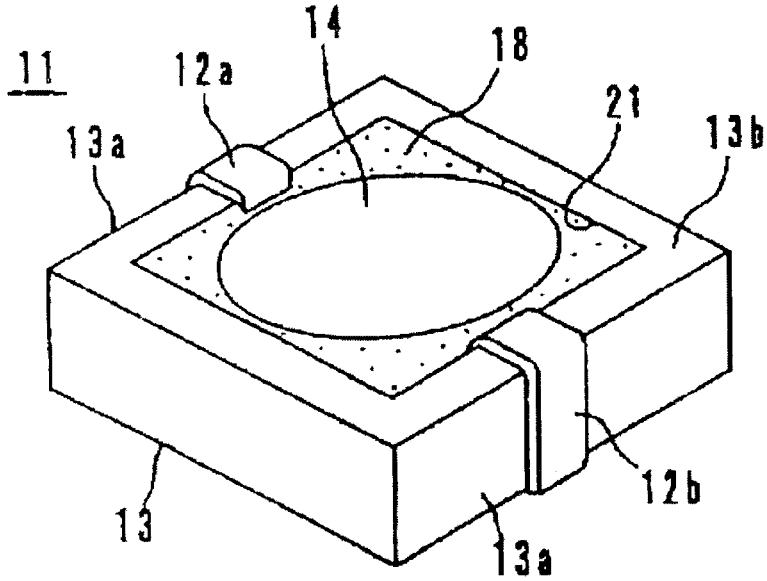
FIG. 2 is an external perspective view of the surface-mounting-type coil component shown in FIG. 1, as seen from the mounting surface side.

A description will now be provided of a first preferred embodiment of the surface-mounting-type coil component, with reference to FIGS. 1 and 2. As shown in FIG. 1, a surface-mounting-type coil component 11 preferably includes a coil 12, a first core member 13 preferably having a substantially rectangular box shape, and a second core member 14 defining a lid arranged to cover the coil 12 and the first core member 13. The coil 12 is preferably formed by concentrically winding a flat straight wire into a substantially circular configuration or by subjecting the flat straight wire to edgewise winding). The straight wire is, for example, a straight copper wire (a ribbon or a metal foil) with an insulating film, such as a polyurethane film or a polyester film, provided on its surface.

In the coil 12, an extending portion 12*b* is extended outwardly by edgewise bending from a winding terminated location 25 located at the upper side of the coil 12 in an axial direction thereof. Similarly, an extending portion 12*a* is extended outwardly by edgewise bending from a winding-termination location located at the lower side of the coil 12 in the axial direction thereof. When the extending portion 12*a* is extended outwardly, a portion thereof is bent upward at an angle of about 90 degrees, and then bent again at an angle of about 90 degrees so that it lies in the same plane as the plane in which the extending portion 12*b* lies. In other words, the extending portions 12*a* and 12*b* are extended in opposite directions so that they are separated by about 180 degrees along a straight line L that passes through the center of the edgewise wound portion 12*c*. Accordingly, the extending portions 12*a* and 12*b* can easily be extended outwardly from the edgewise wound portion 12*c* by carrying out edgewise bending, that is, an edgewise winding technique.

A substantially rectangular recess 21 is provided in the approximate center portion of a mounting surface 13*b* of the substantially rectangular box-shaped core member 13 in order to accommodate the coil 12 therein. A substantially cylindrical core portion 22 is provided in the approximate center portion of the recess 21. The lid core member 14 to cover is used to cover the recess 21 in the box-shaped core member 13. The core members 13 and 14 are preferably made of, for example, an insulating material or a magnetic material. In the first preferred embodiment, a magnetic material, such as a ferrite material, is preferably used to form the box-shaped core member 13 and the lid core member 14. Therefore, the core members 13 and 14 which are combined define a closed magnetic circuit.

The insulating films on the surfaces of the extending portions 12*a* and 12*b* of the coil 12 are removed in advance, after which, if necessary, the extending portions 12*a* and 12*b* may be subjected to solder plating operations and solder dipping operations. Removal of the insulating films from the extending portions 12*a* and 12*b* or solder plating operations on the extending portions 12*a* and 12*b* do not necessarily have to be previously carried out early in the forming process of the coil component 11. Such processes may be carried out later in the forming process of the coil component 11. The coil 12 is then accommodated in the recess 21 in the box-shaped core member 13, and the core portion 22 is inserted into a hole 12*c* defined in the approximate center portion of the coil 12. After the insertion of the core portion 22, the extending portions 12*a* and 12*b* of the coil 12 are disposed at the mounting surface 13*b* of the box-shaped core member 13 in order to be extended outwardly. After the extending portions 12*a* and 12*b* have been extended outwardly, the lid core member 14 to cover is placed on the coil 12 in order to cover an opening of the recess 21. Thereafter, if necessary, the recess 21 may be filled with resin (or an adhesive) 18.

As shown in FIG. 2, the extending portions 12*a* and 12*b* of the coil 12 disposed at the mounting surface 13*b* of the box-shaped core member 13 are bent along respective outer side walls 13*a* of the box-shaped core member 13 in order to be used as surface-mounting external electrodes.

In the surface-mounting-type coil component 11 having the above-described structure, the extending portions 12*a* and 12*b* of the coil 12 are extended opposite to each other so that they are separated by about 180 degrees along the straight line L that passes through the center of the edgewise wound portion 12*c*. Therefore, even when the extending portions 12*a* and 12*b* are bent along their respective side walls 13*a* of the box-shaped core member 13, they are not elevated from the mounting surface 13*b*. As a result, the mounting surface 13*b* of the coil component 11 is reliably located at a correct level position, thereby greatly improving the mountability of the component on a printed circuit board or other substrate.

In addition, in the surface-mounting-type coil component 11, since the surface mounting external electrodes defined by the bent extending portions 12*a* and 12*b* are arranged opposite each other, the coil component 11 is mounted reliably and stably at a a level position on a printed circuit board or substrate. Therefore, the coil component 11 is reliably and securely mounted and does not experience shaking or instability after it has been mounted on the printed circuit board or substrate.

Further, in the surface-mounting-type coil component 11, since the extending portions 12*a* and 12*b* of the coil 12 are disposed symmetrically opposite each other with respect to the center of the windings of the coil 12 so as to be separated by about 180 degrees, the magnetic flux lines in the magnetic path defined by the core members 13 and 14 will not flow to one side. The magnetic flux is not biased or slanted. This greatly improves magnetic saturation properties, so that the coil component 11 generates the inductance with high efficiency.

Figure 3:
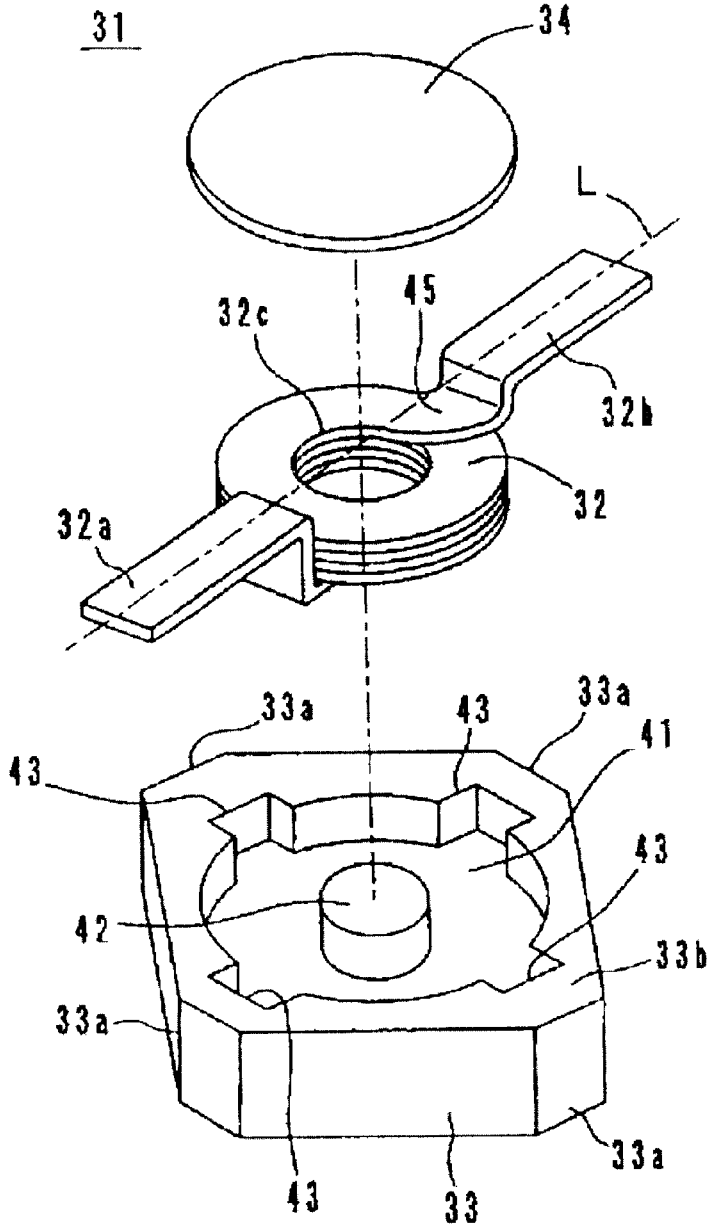
FIG. 3 is an exploded perspective view of a second preferred embodiment of the coil and the surface-mounting-type coil component in accordance with the present invention.

A description will now be provided for a second preferred embodiment of the surface-mounting-type coil component with reference to FIGS. 3 to 6. As shown in FIG. 3, the surface-mounting-type coil component 31 preferably includes a coil 32, a first core member 33 having a substantially rectangular box-shape, and a second core member 34 arranged to cover the component 31 and the first core member 33. The coil 32 is preferably formed by concentrically winding a flat straight wire into a substantially circular form or by forming it into an edgewise winding.

In the coil 32, an extending portion 32*b* is extended outwardly by edgewise bending from a winding-termination location 45 disposed at the upper side of the coil 32 in an axial direction thereof. When the extending portion 32*b* is extended outwardly, a portion thereof is bent upward at an angle of about 90 degrees, and then a predetermined portion thereof is bent again at an angle of about 90 degrees towards the outer side. Similarly, an extending portion 32*a* is extended outwardly by edgewise bending from a winding-termination location disposed at the lower side of the coil 32 in the axial direction thereof. When the extending portion 32*a* is extended outwardly, a portion thereof is bent upward at an angle of 90 degrees, and then a predetermined portion thereof is bent again at an angle of 90 degrees towards the outer side so as to lie in the same plane in which the plane of the extending portion 32*b* lies. The extending portions 32*a* and 32*b* are extended outwardly in opposite directions so that they are separated by about 180 degrees along a straight line L that passes through the center of the edgewise wound portion. Accordingly, the extending portions 32*a* and 32*b* can be easily extended outwardly by edgewise bending, that is, an edgewise winding technique.

A substantially circular recess 41 is located at the approximate center portion of a mounting surface 33*b* of the box-shaped core member 33 in order to accommodate the coil 32 therein. The four corners of the box-shaped core member 33 are removed and beveled. A substantially cylindrical core portion 42 is provided in the approximate center of the recess 41. This core portion 42 does not have to be integral with the box-shaped core member 33. Grooves 43 are located in the side wall defining the recess 41 at approximately 90 degree intervals. In other words, the grooves 43 are arranged so as to oppose respective cut-away portions (or beveled corners) 33*a* defined by removing the four corners of the box-shaped core member 33. There are four of these grooves 43 provided at approximate 90 degree intervals in order to eliminate directional limitations during assembly of the coil component 31. It is possible to assemble the coil component 31 in either direction.

The lid core member 34 is arranged to cover the recess 41 in the box-shaped core member 33. The core member 33 and the lid core member 34 are preferably made of, for example, an insulating material or a magnetic material. In the second preferred embodiment, ferrite or other magnetic materials are used to form the core members 33 and 34. The core members 33 and 34 together define a closed magnetic circuit.

The coil 32 is accommodated in the recess 41 provided in the core member 33, and the core portion 42 is inserted into a hole 32*c* provided in the approximate center of the coil 32. Then, a portion of the extending portion 32*a* and a portion of the extending portion 32*b* are accommodated in any two opposing grooves 43. One end portion of the extending portion 32*a* and one end portion of the extending portion 32*b* are disposed at the mounting surface 33*b* of the core member 33 so as to extend outwardly. Thereafter, the core member 34 is placed on the coil 32 in order to cover an opening of the recess 41, after which, if necessary, the recess 41 may be filled with resin or adhesive 38 (see FIG. 4).

Figure 4:
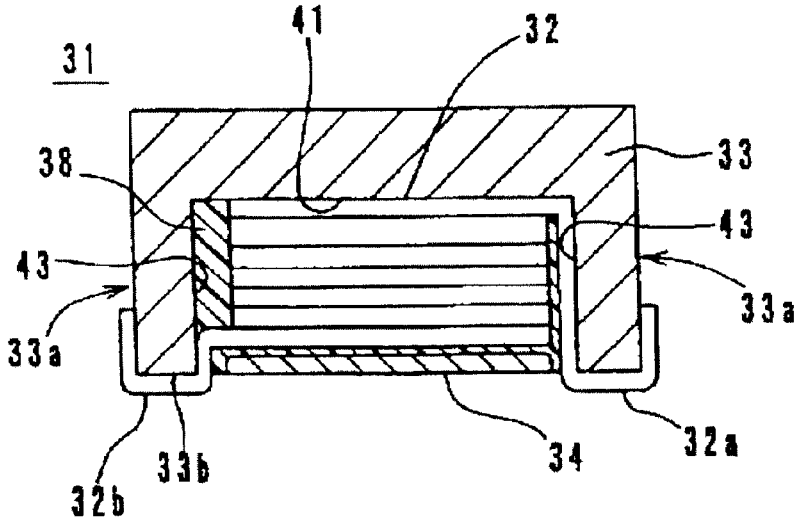
FIG. 4 is a vertical sectional view of the surface-mounting-type coil component shown in FIG. 3.
Figure 5:
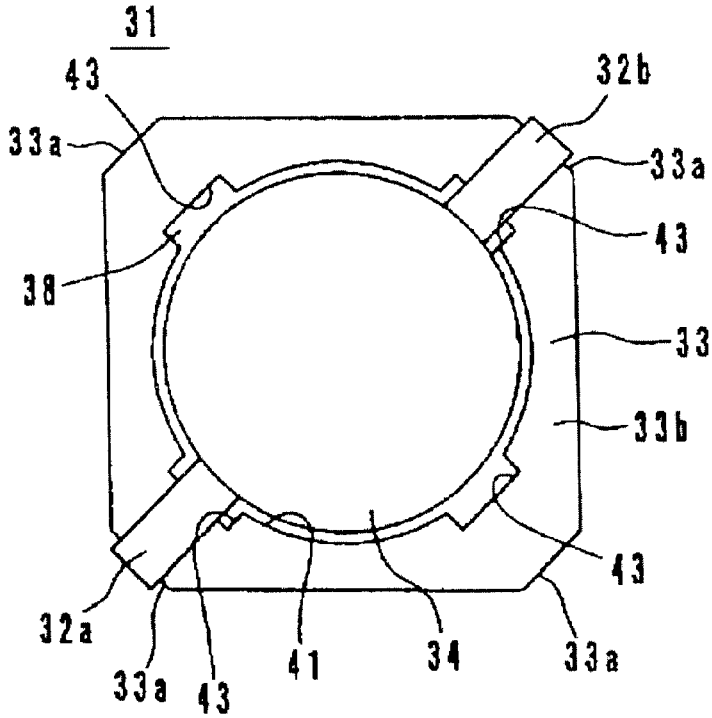
FIG. 5 is a bottom view of the surface mounting type coil component shown in FIG. 3.

As shown in FIGS. 4 and 5, the extending portions 32*a* and 32*b* disposed at the mounting surface 33*b* of the core member 33 are bent along their corresponding cut-away portions (beveled corners) 33*a* of the core member 33 in order to be used as surface mounting external electrodes.

In the surface-mounting-type coil component 31 having the above-described structure, the extending portions 32*a* and 32*b* of the coil 31 are extended opposite each other so that they are separated by about 180 degrees along the straight line L that passes through the center of the edgewise wound portion. Therefore, even when the extending portions 32*a* and 32*b* are bent along respective cut-away portions 33*a* of the box-shaped core member 33, they are not elevated from the mounting surface 33*b*. As a result, the mounting surface 33*b* of the coil component 31 is reliably located in its proper level position, thereby greatly improving mountability with respect to, for example, a printed circuit board or substrate.

In addition, in the surface-mounting-type coil component 31, since the surface-mounting external electrodes defined by bending the extending portions 32*a* and 32*b*, are provided opposite each other, the coil component 31 is located at its proper level position when it is mounted on, for example, a printed circuit board. Therefore, it does not cause the problem of the coil component 31 being unstable and shaking after it has been mounted on the printed circuit board.

Further, in the surface-mounting-type coil component 31, since the extending portions 32*a* and 32*b* of the coil 32 are disposed symmetrically opposite each other with respect to the center of the windings of the coil 32 so as to be separated by about 180 degrees, the magnetic flux lines in the magnetic path defined by the core members 33 and 34 will not flow to one side. This improves magnetic saturation properties, so that a coil component 31 generates the inductance with high efficiency.

Figure 6:
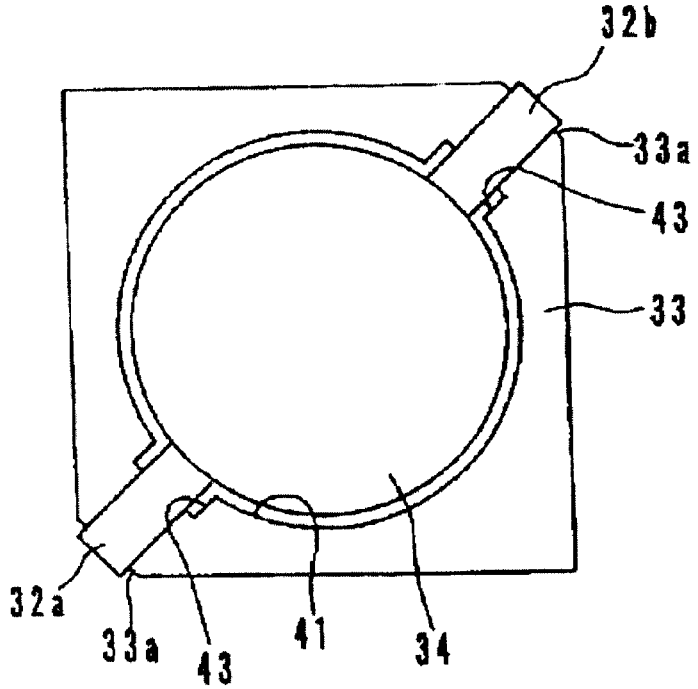
FIG. 6 is a bottom view of a modification of the surface-mounting-type coil component shown in FIG. 3.

Still further, by removing the corners of the core member 33, substantially the entire box-shaped core member 33 functions effectively as a magnetic circuit, so that space is not wasted. This allows inductance to occur even more efficiently. The cutouts 43 may be formed at approximately 180 degree intervals in the side wall defining the recess 41, as shown in FIG. 6.

Figure 7:
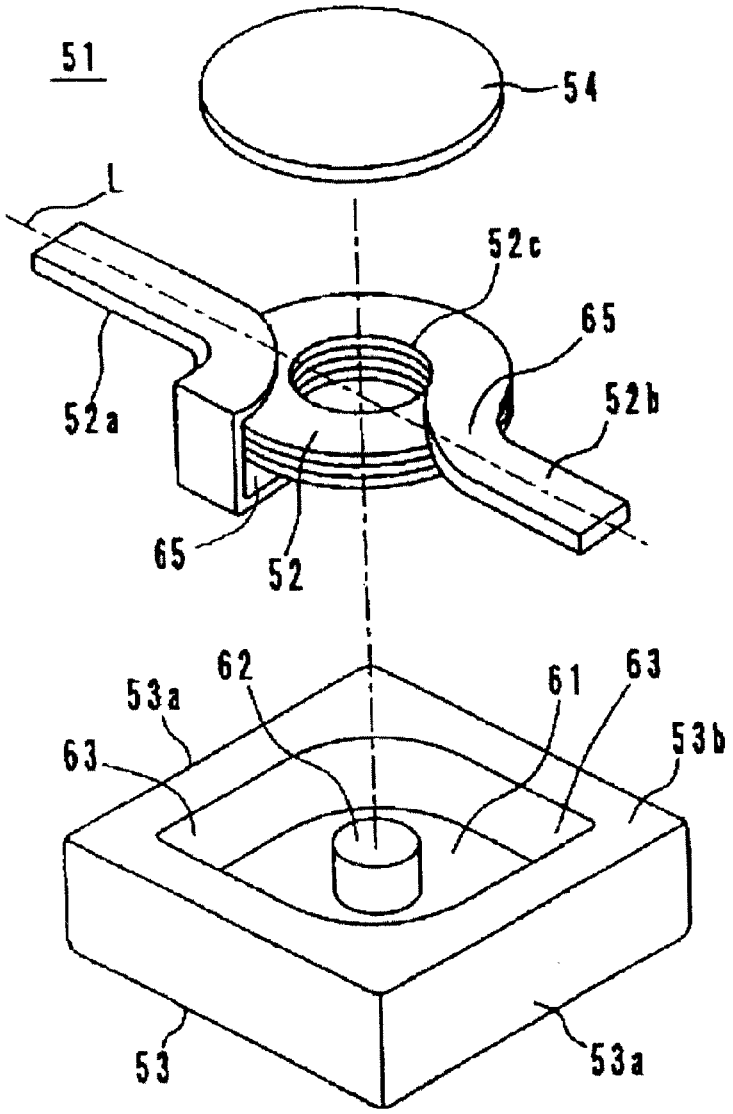
FIG. 7 is an exploded perspective view of a third preferred embodiment of the coil and the surface-mounting-type coil component in accordance with the present invention.
Figure 8:
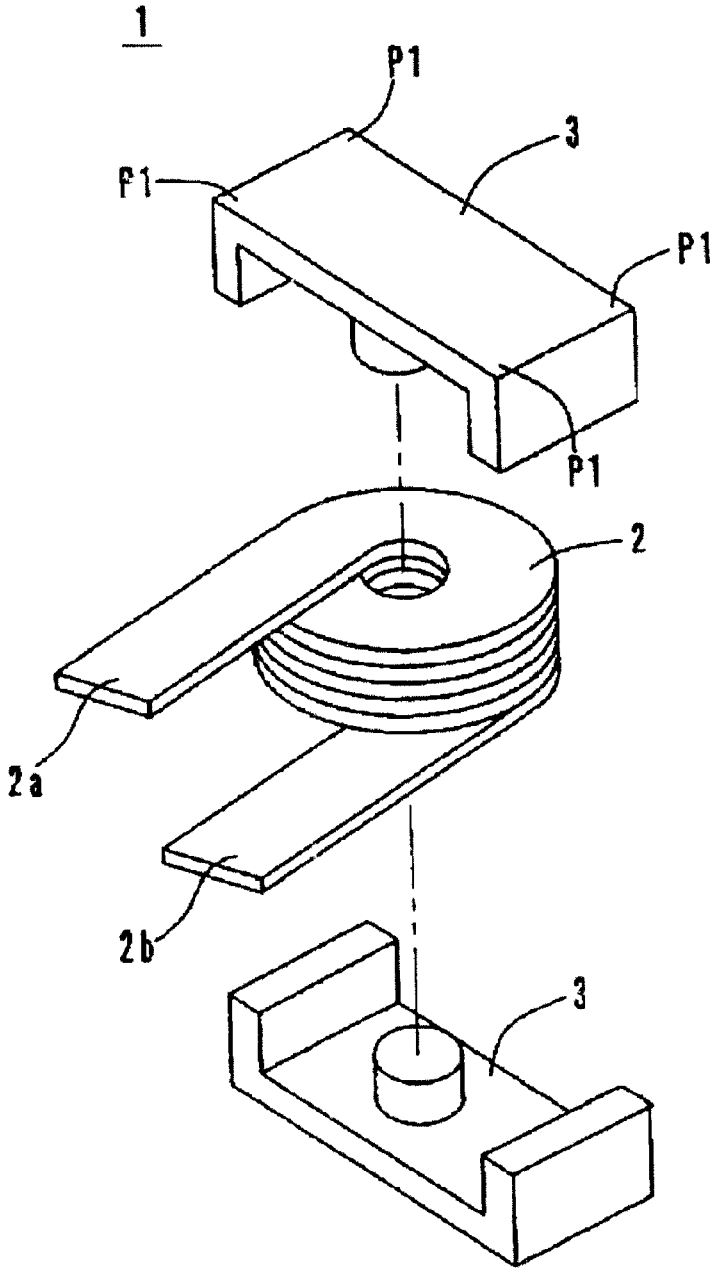
Fig.8 PRIOR ART
FIG. 8 is an exploded perspective view of a conventional coil component.
Figure 9:
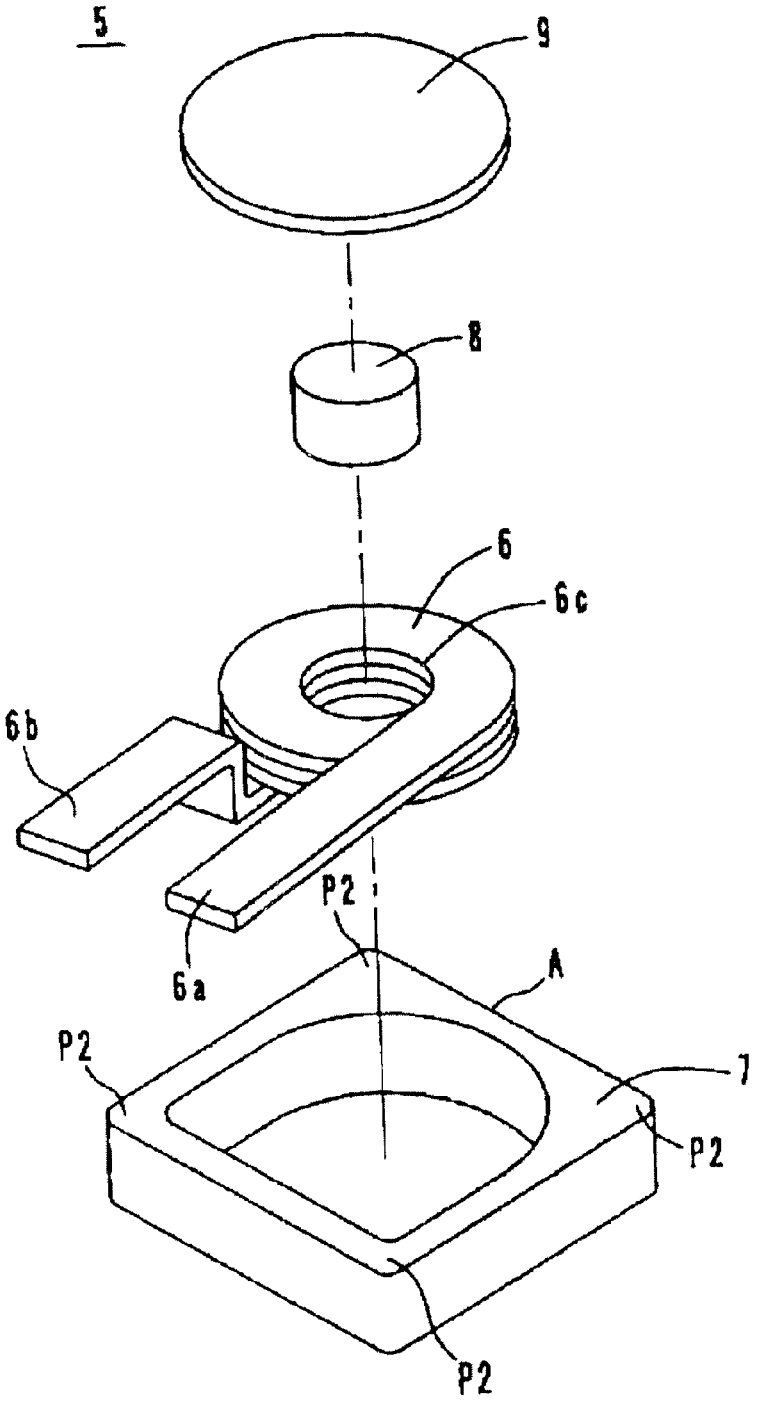
Fig.9 PRIOR ART
FIG. 9 is an exploded perspective view of another conventional coil component.
Figure 10:
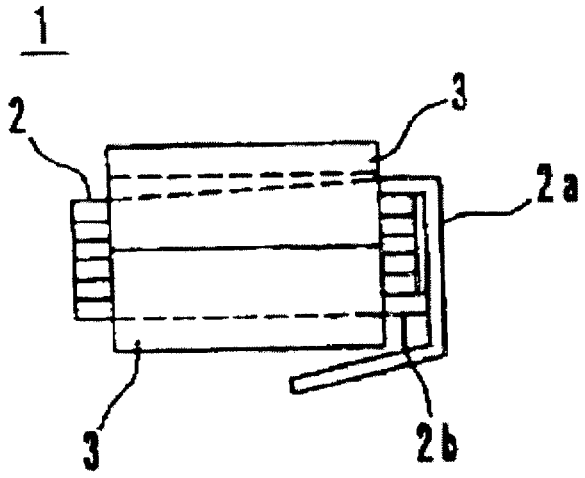
Fig.10 PRIOR ART
FIG. 10 is a side view of the coil component shown in FIG. 8.

A description will now be provided of a third preferred embodiment of the surface-mounting-type coil component, with reference to FIG. 7. A surface-mounting-type coil component 51 of the third preferred embodiment includes a coil in which the angle defined by the two winding-termination locations and that defined by the two extending portions are different. As shown in FIG. 7, the surface-mounting-type coil component 51 includes a coil 52, a first core member 53 having a substantially rectangular box-shape, and a second core member 54 defining a lid and arranged to cover the coil 52 and the first core member 53. The coil 52 is preferably formed by subjecting a straight wire to edgewise winding. The core members 53 and 54 are made of, for example, an insulating material or a magnetic material.

In the coil 52, an extending portion 52*b* is extended outwardly by edgewise bending from a winding-termination location 65 located at the upper side of the coil 52 in an axial direction thereof. Similarly, an extending portion 52*a* is extended outwardly by edgewise bending from a winding termination location located at the lower side of the coil 52 in the axial direction thereof. When the extending portion 52*a* is extended outwardly, a portion thereof is bent upward at an angle of about 90 degrees, and then bent inwardly at an angle of about 90 degrees in the same plane as the plane in which the extending portion 52*b* lies. Then, the extending portion 52*a* is subjected to edgewise bending so as to extend outwardly. The two winding-termination locations 65 of the coil 52 defines an angle of about 90 degrees relative to each other, while the two extending portions 52*a* and 52*b* defines an angle of about 180 degrees relative to each other.

A recess 61 is provided in the approximate center portion of a mounting surface 53*b* of the substantially rectangular, box-shaped core member 53 in order to accommodate the coil 52 therein. The recess 61 preferably has a shape defined by opposing curved lines, each with a circumference that is about ¼th that of a circle, and lines tangential to the curved lines. The lid core member 54 can be easily disposed in the proper position in the recess 61 with this shape, thereby reducing variations in the inductance values. A substantially cylindrical core portion 62 is provided in the approximate center of the recess 61.

The coil 52 is accommodated in the recess 61 provided in the box-shaped core member 53, and the substantially cylindrical core portion 62 is inserted into a hole 52*c* provided in the approximate center portion of the coil 52. Then, the extending portions 52*a* and 52*b* of the coil 52 are disposed at the mounting surface 53*b* of the box-shaped core member 53. Thereafter, the core member 54 to cover is placed on the coil 52 in order to cover the recess 61, and, if necessary, the recess 61 may be filled with resin or adhesive 38 (see FIG. 4).

The extending portions 52*a* and 52*b* of the coil 52 disposed at the mounting surface 53*b* of the box-shaped core member 53 are bent along respective side walls 53*a* of the core member 53 in order to be used as surface-mounting external electrodes.

The surface-mounting-type coil component 51 having the above-described structure provides the same operational advantages as the surface-mounting-type coil component 11 of the first preferred embodiment. In the coil component 11 of the first preferred embodiment, the angle defined by the two winding termination locations 25 of the coil 12 and that defined by the extending portions 12*a* and 12*b* are the same, (in other words, the directions in which the winding-termination locations 25 and the extending portions 12*a* and 12*b* are extended are the same). In contrast, in the coil component 51 of the third preferred embodiment, the extending portions 52*a* and 52*b* are extended so that the directions in which the two winding-termination locations 65 of the coil 52 are oriented are set independently of the directions in which the extending portions 52*a* and 52*b* extend. The angle defined by the positions of the two winding-termination 65 are set differently from the angle defined by the extending direction of the extending portions 52*a* and 52*b*. As a result, the angle defined by the two winding-termination locations 65, (i.e. positions of the two winding-termination), may be set arbitrarily at any value, making it possible to set the inductance of the coil 52 at a desired value.

It is to be noted that the present invention is not limited to the above-described preferred embodiments of the surface-mounting-type coil component, so that various modifications may be made within the gist and scope of the invention. For example, the form of the box-shaped core member may be modified. Although the box-shaped core member shown in FIG. 3 has a substantially octagonal in shape as a result of removing the four corners thereof, and the box-shaped core member shown in FIG. 6 is substantially hexagonal in shape as a result of removing two corners thereof, it can be formed into any other polygonal shape, or into a substantially circular or a substantially rectangular shape in accordance with the specification of the product demanded by the user. In addition, the coil accommodating portion may be structured differently. Although in the above-described preferred embodiments the coil accommodating portion is defined by a combination of a box-shaped member and a lid core member, it may be formed by combining two box-shaped core members arranged to engage with each other or to abut against each other, in the interior of which the coil is accommodated.

As can be understood from the foregoing description, according to the present invention, two extending portions of a coil are extended in opposite directions so as to be separated by about 180 degrees along a straight line passing through a center of the edgewise wound portion of the coil. Therefore, even when the extending portions are bent along the surface of the core member, they are not elevated therefrom. This allows a mounting surface of the coil component to be reliably mounted stably and securely level, thereby greatly improving mountability of the coil component with respect to, for example, a printed circuit board or substrate. In addition, the extending portions of the coil can be extended by the technique used to wind a straight wire edgewise. In other words, from their respective winding-termination locations, the extending portions can be easily extended opposite to each other so as to be separated by about 180 degrees by edgewise bending.

In addition, according to the present invention, since the surface-mounting external electrodes defined by bending the extending portions are disposed at both sides of the coil component, the coil component is reliably positioned at its proper level position when it is mounted on, for example, a printed circuit board or substrate. As a result, shaking of the coil component after it has been mounted to the printed circuit board is eliminated. In the present invention, the extending portions of the coil are not provided only at one side of the center of the windings of the coil, and the compnent is not disposed in an inclined position, so that local concentration of magnetic flux lines does not occur at the core member. This improves magnetic saturation properties of the core member, making it possible to provide a coil component that allows inductance to occur with high efficiency.

Further, according to the present invention, by cutting the corners of the box-shaped core member, substantially the entire box-shaped core member can function effectively as a magnetic circuit. Therefore, inductance is generated with even greater efficiency, as a result of which space is not wasted.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A coil comprising:

an edgewise wound portion defined by a flat wire having two major surfaces and edges extending between the two major surfaces that is wound such that the major surfaces of the flat wire extend in a horizontal direction and are stacked on each other in a vertical direction and such that the edges of the flat wire extend in the vertical direction and are substantially flush with and stacked on each other in the vertical direction; and two extending portions extending from upper and lower portions of the edgewise wound portion, the two extending portions being arranged to extend opposite to each other so as to be separated by an angle of about 180 degrees along a line passing through a center of the edgewise wound portion.

2. A coil according to claim 1, wherein an angle separating the two locations of the edgewise wound portion from which the two extending portions extend and an angle separating the two extending portions are different.

3. A surface-mounting-type coil component, comprising:

a coil including an edgewise wound portion defined by a flat wire having two major surfaces and edges extending between the two major surfaces that is wound such that the major surfaces of the flat wire extend in a horizontal direction and are stacked on each other in a vertical direction and such that the edges of the flat wire extend in the vertical direction and are substantially flush with and stacked on each other in the vertical direction, and two extending portions extending from upper and lower portions of the edgewise wound portion, the two extending portions being arranged to extend opposite to each other so as to be separated by an angle of about 180 degrees along a line passing through a center of the edgewise wound portion; and a core accommodating the coil therein.

4. A surface-mounting-type coil component according to claim 3, wherein the core comprises a first box-shaped core member having a recess for accommodating the coil therein, and a second core member arranged to cover an opening of the recess of the first box-shaped core member.

5. A surface-mounting-type coil component according to claim 4, wherein the recess is substantially rectangular.

6. A surface-mounting-type coil component according to claim 4, wherein the recess is substantially circular.

7. A surface-mounting-type coil component according to claim 4, wherein the first core member has a substantially box-shaped configuration.

8. A surface-mounting-type coil component according to claim 4, wherein the first box-shaped core member includes grooves for accommodating the extending portions of the coil therein, the grooves being formed in the first box-shaped core member so as to be spaced from each other at approximately 90 degree intervals or at approximately 180 degree intervals.

9. A surface-mounting-type coil component according to claim 4, wherein a corner of the first box-shaped core member is beveled.

10. A surface-mounting-type coil component according to claim 4, wherein the first core member and the second core member are made of a magnetic material.

11. A surface mounting-type coil component according to claim 4, wherein the extending portions are bent along outer side walls of the first core member, and the extending portions define surface-mounting type external electrodes.

12. A surface-mounting-type coil component according to claim 3, wherein at least one of the extending portions includes a first portion that is bent upward at an angle of about 90 degrees and a second portion that is bent at an angle of about 90 degrees relative to the first portion.

13. A surface-mounting-type coil component according to claim 3, wherein the first and second core members are arranged to define a closed magnetic circuit.

14. A surface-mounting-type coil component according to claim 4, the first box-shaped core member Includes four corners that are beveled.

15. A surface-mounting-type coil component according to claim 3, wherein the extending portions include portions which are disposed at a mounting surface of the first core member and are bent to define surface mounting external electrodes.

16. A surface-mounting-type coil component according to claim 3, wherein the first core member is box-shaped and is arranged such that substantially the entire box-shaped core member defines a magnetic circuit.

17. A surface-mounting-type coil component according to claim 3, wherein the core comprises a first core member having a recess for accommodating the coil therein and a second core member arranged to define a lid covering the coil and the first core member, the recess of the first core member has a shape defined by opposing curved lines each having a circumference that is about ¼th that of a circle and lines tangential to the curved lines.

18. A surface-mounting-type coil component according to claim 17, wherein the first core member includes a substantially cylindrical core portion located at an approximate center of the recess.

19. A surface-mounting-type coil component according to claim 3, wherein the core has one of a substantially octagonal shape, a substantially circular shape, and a substantially rectangular shape.

* * * * *